US008474949B2

(12) United States Patent
Kimura et al.

(10) Patent No.: US 8,474,949 B2
(45) Date of Patent: Jul. 2, 2013

(54) PRINTING APPARATUS, CLEANING DEVICE OF INK-JET HEAD AND CLEANING METHOD OF INK-JET HEAD

(75) Inventors: Kazuhisa Kimura, Kanagawa-ken (JP); Noboru Nitta, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/218,209

(22) Filed: Aug. 25, 2011

(65) Prior Publication Data

US 2012/0105539 A1 May 3, 2012

(30) Foreign Application Priority Data

Oct. 27, 2010 (JP) ..... 2010-241280

(51) Int. Cl.
*B41J 2/165* (2006.01)

(52) U.S. Cl.
USPC ..... 347/30

(58) Field of Classification Search
USPC ..... 347/22, 23, 30, 34, 35
See application file for complete search history.

(56) References Cited

U.S. PATENT DOCUMENTS

| | | | | |
|---|---|---|---|---|
| 6,578,947 | B1 * | 6/2003 | Suwabe et al. | 347/29 |
| 7,244,012 | B2 * | 7/2007 | Yamada et al. | 347/28 |
| 7,490,921 | B2 | 2/2009 | Hashi et al. | |
| 7,766,450 | B2 * | 8/2010 | Nishizaki et al. | 347/33 |

FOREIGN PATENT DOCUMENTS

| | | |
|---|---|---|
| JP | 5201028 | 8/1993 |
| JP | 2006-181837 | 7/2006 |
| JP | 2006-213026 | 8/2006 |
| JP | 2009-137210 | 6/2009 |

* cited by examiner

*Primary Examiner* — Lamson Nguyen
(74) *Attorney, Agent, or Firm* — Patterson & Sheridan, L.L.P.

(57) ABSTRACT

According to one embodiment, a printing apparatus includes an ink-jet head including a nozzle plate with a nozzle string in which a plurality of nozzle holes for discharging ink are arranged, and a cleaning device including an ink-repellent surface with ink repellency which is configured to come in contact with the nozzle plate in a state in which the ink-repellent surface is opposed to the ink-jet head, an ink-affinitive surface with ink affinity which is configured to create a gap between the ink-affinitive surface and the nozzle plate in a state in which the ink-repellent surface is in contact with the nozzle plate, and to have a smaller ink contact angle than the ink-repellent surface, and a plurality of suction ports formed in the ink-affinitive surface.

19 Claims, 8 Drawing Sheets

PRINTING APPARATUS, CLEANING DEVICE OF INK-JET HEAD AND CLEANING METHOD OF INK-JET HEAD

CROSS-REFERENCE TO RELATED APPLICATION

This application is based upon and claims the benefit of priority from Japanese Patent Application No. 2010-241280, filed on Oct. 27, 2010; the entire contents of which are incorporated herein by reference.

FIELD

Embodiments described herein relate generally to a printing apparatus, a cleaning device of an ink-jet head and a cleaning method of the ink-jet head.

BACKGROUND

A nozzle plate of an ink-jet head includes nozzle holes for discharging ink. In the ink-jet head, in many cases, the surface of the nozzle plate is kept ink-repellent in order to prevent excess ink from remaining in the vicinity of the nozzle holes when ink is discharged from the nozzle holes.

As regards this ink-jet head, there is known a technique of performing, with a suction nozzle, suction-cleaning of ink or the like which adheres to the nozzle plate in the vicinity of the nozzle holes. For example, there have been proposed such methods as performing suction-cleaning by sliding a suction nozzle while keeping the suction nozzle in contact with the neighborhood of nozzle holes on the nozzle plate, or performing suction-cleaning by moving a suction nozzle while keeping a gap between the suction nozzle and the nozzle plate so that the suction nozzle may not come in contact with the nozzle plate. Besides, if the suction force of the suction nozzle acts in a vertical direction of an ink discharge direction from nozzle holes, the ink may easily be pulled off in the vicinity of the nozzle holes, leading to a factor of occurrence of bubbles in the nozzle. In order to avoid this, there has been proposed a structure of the suction nozzle, which takes into account such a flow of air that the suction force acts in a direction crossing the ink discharge direction.

The surface of the nozzle plate repels ink, since the surface of the nozzle is treated so as to have ink repellency in order to stabilize the ink discharge capability. Thus, when suction-cleaning has been performed by the suction nozzle, ink tends to remain on the surface of the nozzle plate in the form of minute ink drops, and such residual ink drops are hardly moved by the air flow alone. Consequently, the residual ink cannot be removed from the surface of the nozzle plate, and minute ink drops remain. As a result, the ink repellency in the vicinity of nozzle holes of the surface of the nozzle plate may deteriorate, and the quality of printing may be degraded.

DETAILED DESCRIPTION

Figure 1:
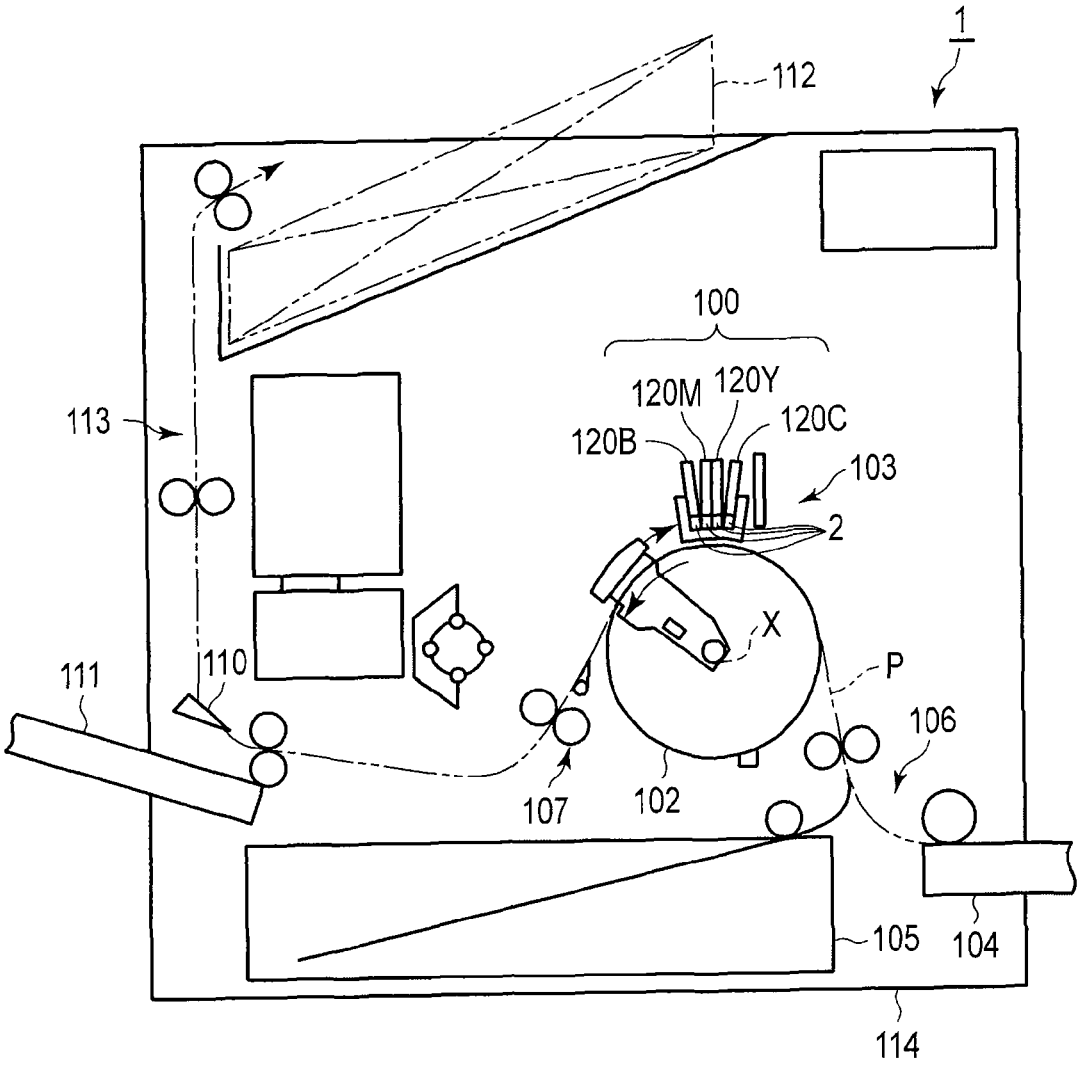
FIG. 1 schematically shows a structure example of an ink-jet recording apparatus which is a printing apparatus of the embodiment.

In general, according to one embodiment, a printing apparatus includes an ink-jet head including a nozzle plate with a nozzle string in which a plurality of nozzle holes for discharging ink are arranged; and a cleaning device including an ink-repellent surface with ink repellency which is configured to come in contact with the nozzle plate in a state in which the ink-repellent surface is opposed to the ink-jet head, an ink-affinitive surface with ink affinity which is configured to create a gap between the ink-affinitive surface and the nozzle plate in a state in which the ink-repellent surface is in contact with the nozzle plate, and to have a smaller ink contact angle than the ink-repellent surface, and a plurality of suction ports formed in the ink-affinitive surface.

In general, according to another embodiment, a cleaning device of an ink-jet head includes a suction nozzle including an ink-repellent surface with ink repellency; an ink-affinitive surface with ink affinity which is configured to be recessed from the ink-repellent surface and to have a smaller ink contact angle than the ink-repellent surface; and a plurality of suction ports formed in the ink-affinitive surface.

In general, according to another embodiment, a cleaning method of an ink-jet head includes moving a suction nozzle, with an ink-repellent surface of the suction nozzle being in contact with a nozzle plate and a gap being created between an ink-affinitive surface of the suction nozzle and the nozzle plate, in a state in which the ink-jet head including the nozzle plate with a nozzle string, in which a plurality of nozzle holes for discharging ink are arranged, is opposed to the suction nozzle; and sucking ink, which is drawn by an air flow in the gap, from a plurality of suction ports formed in the ink-affinitive surface.

The embodiment will now be described in detail with reference to the accompanying drawings. In the drawings, structural elements having the same or similar functions are denoted by like reference numerals, and an overlapping description thereof is omitted.

FIG. 1 schematically shows a structure example of an ink-jet recording apparatus 1 which is a printing apparatus of the embodiment.

Specifically, the ink-jet recording apparatus 1 effects color printing on a paper sheet which is a recording medium. As the paper sheet, use may be made of plain paper, coated paper, OHP sheets, etc.

The ink-jet recording apparatus 1 includes a paper path P within a housing 114. The paper path P is a path from a manual feed tray 104 or a paper cassette 105 to a paper discharge tray 111 or a paper discharge tray 112 via a printing section 100. A paper feed mechanism 106 feeds paper sheets, which are stacked in the manual feed tray 104 or paper cassette 105, to the paper path P by separating the paper sheets one by one.

A paper discharge mechanism 107, a sort gate 110 and a paper convey mechanism 113 are provided along the paper path P. The paper discharge mechanism 107 discharges paper, on which printing has been effected by the printing section 100, to the paper discharge tray 111 or paper discharge tray 112. The sort gate 110 sorts paper to a paper discharge destination of the paper discharge tray 111 or paper discharge tray 112. The paper convey mechanism 113 conveys the paper, which has been sorted by the sort gate 110, to the paper discharge tray 112.

The printing section 100 includes a drum 102 and a printing unit 103. The drum 102 rotates at a predetermined speed, while carrying paper on its outer periphery. The printing unit 103 effects printing on the paper carried on the drum 102, on the basis of print data.

The printing unit 103 includes, for example, four nozzle units 120C (cyan), 120Y (yellow), 120M (magenta) and 120B (black). If it is assumed that in the paper path P, the side of the paper feed mechanism 106 is an upstream side and the side of the paper discharge mechanism 107 is a downstream side, the nozzle units 120C, 120Y, 120M and 120B are arranged in the named order from the upstream side.

Each of the nozzle units 120C, 120Y, 120M and 120B includes an ink-jet head 2, which will be described later. The ink-jet heads 2 of the respective nozzle units 120C, 120Y, 120M and 120B are arranged along a first direction X which is parallel to the axis of rotation of the drum 102. The nozzles of the ink-jet heads 2 are opposed to the upper side of the drum 102.

Furthermore, the ink-jet recording apparatus 1 includes a cleaning device 3, which will be described later.

Figure 2:
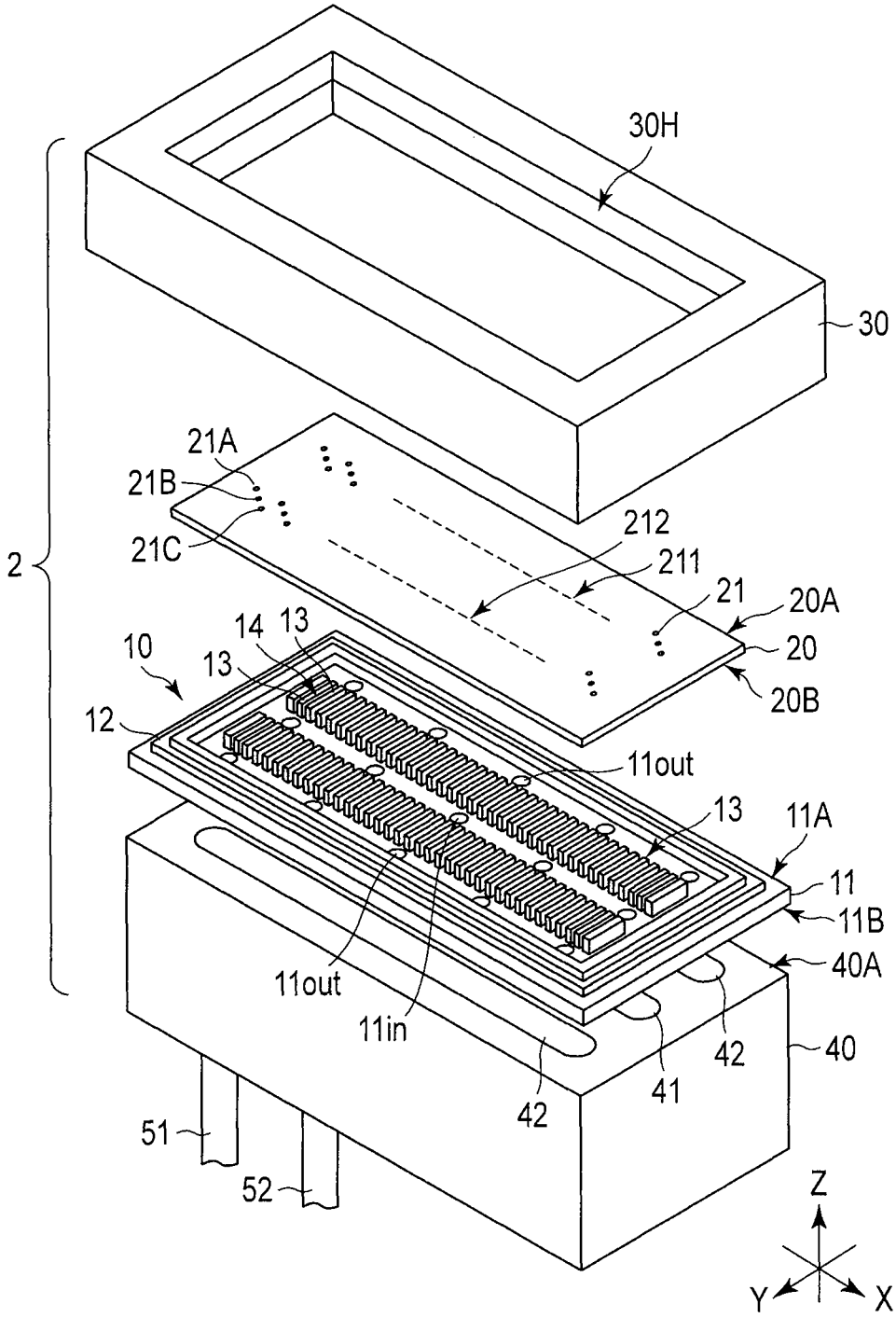
FIG. 2 is an exploded perspective view which schematically shows the structure of an ink-jet head in the ink-jet recording apparatus.

FIG. 2 is an exploded perspective view which schematically shows the structure of the ink-jet head 2 in the ink-jet recording apparatus 1 shown in FIG. 1.

Specifically, the ink-jet head 2 includes a main module 10, a nozzle plate 20, a mask plate 30 and a holder 40. The ink-jet head 2 has a substantially rectangular shape having a longitudinal direction in the first direction X which is parallel to the axis of rotation of the above-described drum. In the description below, a direction which is substantially perpendicular to the first direction X is a second direction Y, a direction which is perpendicular to an X-Y plane is a third direction Z, the "upper" in the third direction Z corresponds to the drum side (or the direction of gravity) and the "lower" in the third direction Z corresponds to a side away from the drum (or the direction of antigravity).

The main module 10 includes an insulative substrate 11, a frame body 12 and piezoelectric members 13.

The insulative substrate 11 is formed of ceramics such as alumina. The insulative substrate 11 has a substantially rectangular plate shape extending in the first direction X. The insulative substrate 11 has an upper surface 11A which is opposed to the nozzle plate 20, and a lower surface 11B which is opposed to the holder 40. The insulative substrate 11 includes ink supply ports 11in and ink exhaust ports 11out. The ink supply ports 11in and ink exhaust ports 11out penetrate from the upper surface 11A to the lower surface 11B.

The frame body 12 is formed of, e.g. a metal. The frame body 12 has a rectangular frame shape. The frame body 12 is disposed on the upper surface 11A of the insulative substrate 11. The piezoelectric members 13 are formed of, e.g. PZT (lead zirconate titanate). The piezoelectric members 13 are disposed in an inside area surrounded by the frame body 12 on the upper surface 11A of the insulative substrate 11. Each of the piezoelectric members 13 extends in the second direction Y which is substantially perpendicular to the first direction X. The piezoelectric members 13 are arranged in the first direction X. Ink pressure chambers 14 each having a slit shape extending in the second direction Y are formed between each pair of piezoelectric members 13 that are arranged in the first direction X.

In the example illustrated, the piezoelectric members 13 are arranged in two rows in the first direction X. The ink supply ports 11in are arranged in the first direction X at a substantially central part of the insulative substrate 11, that is, between the two rows of piezoelectric members 13. The ink exhaust ports 11out are arranged in the first direction X at peripheral parts of the insulative substrate 11, that is, between the piezoelectric members 13 and the frame body 12. By this structure, ink is supplied from the ink supply ports 11in to the ink pressure chambers 14, and the ink, which passes through the ink pressure chambers 14, is exhausted from the ink exhaust ports 11out.

The nozzle plate 20 is formed of, for example, polyimide. The nozzle plate 20 has a substantially rectangular plate shape extending in the first direction X. The nozzle plate 20 is disposed above the main module 10 along the third direction Z. The nozzle plate 20 has an upper surface (or a nozzle plate surface) 20A which is opposed to the mask plate 30, and a lower surface 20B which is opposed to the main module 10. The lower surface 20B of the nozzle plate 20 is attached to the frame body 12 and piezoelectric members 13 by an adhesive.

The nozzle plate 20 has nozzle holes 21. Each nozzle hole 21 faces the ink pressure chamber 14, and communicates with the ink pressure chamber 14. The nozzle holes 21 are circular in the X-Y plane and are formed to have substantially the same diameter. The diameter of each nozzle hole 31 is, e.g. 30 μm.

The plural nozzle holes 21 are arranged, substantially along the first direction X, and constitute nozzle strings 211 and 212. In the example illustrated, the two nozzle strings 211 and 212 are formed in the nozzle plate 20. However, the number of nozzle strings may be one, or three or more. The distance between the nozzle string 211 and nozzle string 212, that is, the distance in the second direction Y between the center of each of the nozzle holes 21 which form the nozzle string 211 and the center of each of the nozzle holes 21 which form the nozzle string 212, is, for example, 6 mm.

In the present embodiment, the description below is given on the assumption that both the direction of arrangement of nozzle holes 21 forming the nozzle string 211 and the direction of arrangement of nozzle holes 21 forming the nozzle string 212 are parallel to the first direction X that is the longitudinal direction of the ink-jet head 2. Strictly speaking, however, there are cases in which the nozzle holes 21, which form each of the nozzle strings 211 and 212, are not located on a straight line along the first direction X.

In the example illustrated, the mutually neighboring nozzle holes 21 of the nozzle string 211 are not formed on a straight line along the first direction X. Similarly, the mutually neighboring nozzle holes 21 of the nozzle string 212 are not formed on a straight line along the first direction X. In this example, three nozzle holes 21A, 21B and 21C are formed with a gradual displacement in the second direction Y, and every third nozzle hole 21 of the arranged nozzle holes 21 is formed on a straight line along the first direction X. Specifically, the three nozzle holes 21A, 21B and 21C are formed on a straight line which crosses the first direction X and the second direction Y.

The mask plate 30 is formed of, for example, a metal. The mask plate 30 has a frame shape surrounding the nozzle plate 20. The mask plate 30 is disposed above the main module 10 along the third direction Z. The mask plate 30 includes a substantially rectangular opening portion 30H which substantially corresponds to the outer size of the nozzle plate 20. The mask plate 30 and the frame body 12 are attached by an adhesive.

The holder 40 is disposed under the main module 10 along the third direction Z. The holder 40 includes an ink introducing path 41 for introducing ink into the ink supply ports 11in, and ink recovery paths 42 for recovering the ink which is exhausted from the ink exhaust ports clout. An introducing pipe 51 is connected to the ink introducing path 41. The introducing pipe 51 introduces ink from an ink tank to the ink introducing path 41. A recovery pipe 52 is connected to the ink recovery paths 42. The recovery pipe 52 recovers ink from the ink recovery paths 42 into the ink tank. The holder 40 has an upper surface 40A on a side facing the main module 10. The upper surface 40A of the holder 40 and the lower surface 11B of the insulative substrate 11 are attached by an adhesive.

Figure 3:
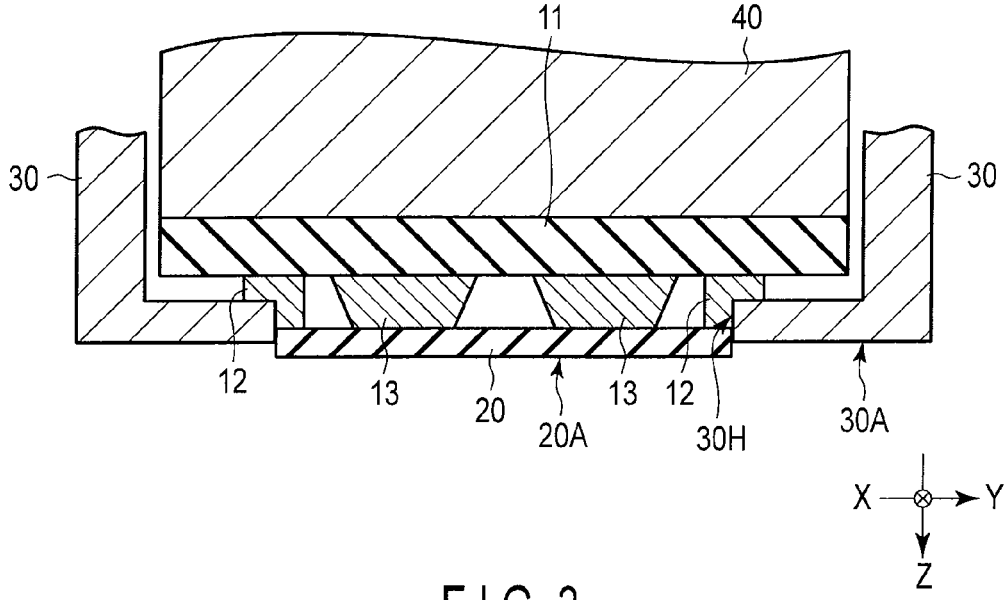
FIG. 3 is a cross-sectional view of the ink-jet head, taken in a second direction.

FIG. 3 is a cross-sectional view which schematically shows a cross-sectional structure, taken along the second direction Y, of the ink-jet head 2 shown in FIG. 2. FIG. 3 shows a cross section including the piezoelectric members 13.

The insulative substrate 11, on which the frame body 12 and piezoelectric members 13 are disposed, is attached to the holder 40. The piezoelectric member 13 has a trapezoidal cross section in the Y-Z plane. The nozzle plate 20 is attached to the frame body 12 and piezoelectric members 13. The mask plate 30 is attached to the frame body 12 on the outside of the nozzle plate 20. The nozzle plate 20 is disposed in the opening portion 30H of the mask plate 30. In this case, the upper surface 20A of the nozzle plate 20 projects from an upper surface 30A of the mask plate 30 in the third direction Z.

The upper surface 20A of the nozzle plate 20 is ink-repellent. For example, the upper surface 20A is formed by coating the nozzle plate 20 of polyimide with a film which is formed of an ink-repellent material, for instance, a fluororesin such as polytetrafluoroethylene. Thereby, the ink discharge capability is stabilized.

Figure 4:
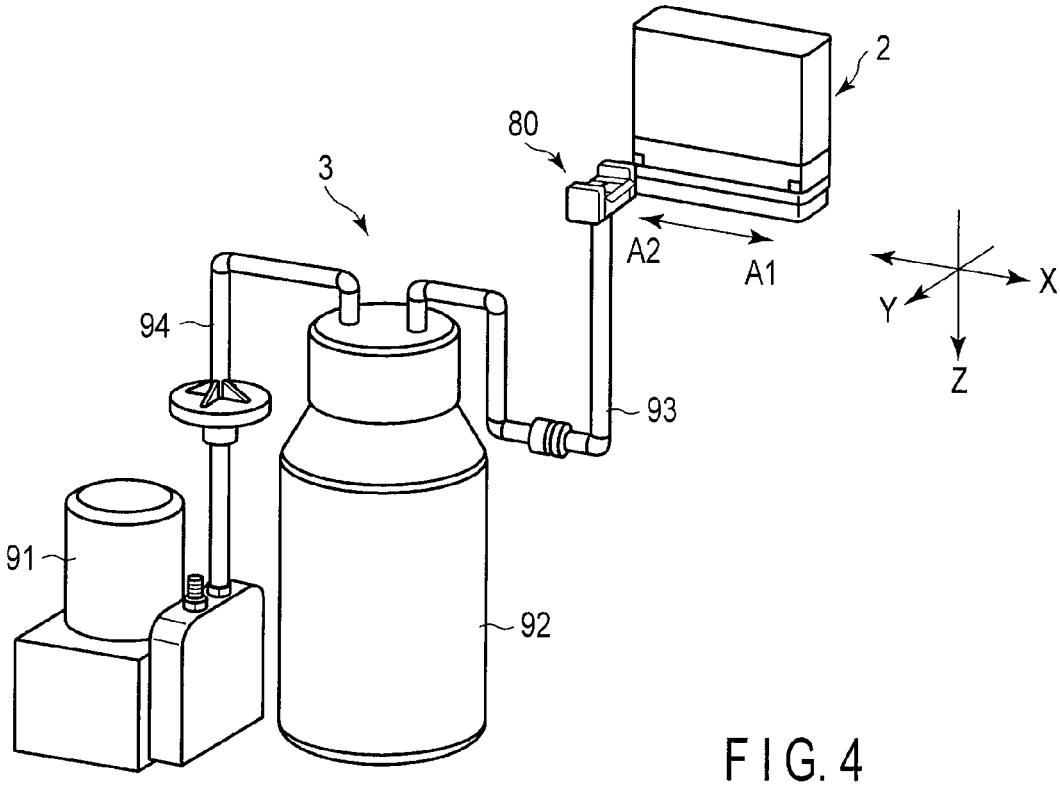
FIG. 4 is a perspective view which schematically shows the structure of a cleaning device for cleaning the ink-jet head.

FIG. 4 is a perspective view which schematically shows the structure of the cleaning device 3 for cleaning the ink-jet head 2 shown in FIG. 2.

Specifically, the cleaning device 3 includes a suction nozzle 80, a suction pump 91 and an ink recovery bin 92. A detailed structure of the suction nozzle 80 will be described later. The suction nozzle 80 and ink recovery bin 92 are connected via a conduit 93. In addition, the suction pump 91 and ink recovery bin 92 are connected via a conduit 94.

The suction nozzle 80 can be moved by a moving mechanism in a longitudinal direction of the ink-jet head 2, that is, in a direction parallel to the first direction X. To be more specific, the suction nozzle 80 is movable between a position where the suction nozzle 80 is not opposed to the ink-jet head 2, for example, a standby position on the left side in FIG. 4, and a position where the suction nozzle 80 is opposed to the ink-jet head 2. The suction nozzle 80, while moving, sucks and cleans ink, etc. adhering to the nozzle plate of the ink-jet head 2 or to the neighborhood of nozzle holes.

The suction-cleaning is performed when the suction nozzle 80 moves (forward movement) from the standby position toward the position facing the ink-jet head 2, as indicated by an arrow A1, and when the suction nozzle 80 moves (backward movement) from the position facing the ink-jet head 2 toward the standby position, as indicated by an arrow A2. When the suction pump 91 operates and the air pressure in the ink recovery bin 92 is lowered, an air flow occurs in the gap between the suction nozzle 80 and the ink-jet head 2. This air flow sucks ink.

In this description, the case is assumed in which at the time of suction-cleaning, the position of the ink-jet head 2 is fixed, while the suction nozzle 80 moves. Conversely, the position of the suction nozzle 80 may be fixed while the ink-jet head 2 moves. It should suffice if the position of the ink-jet head 2 and the position of the suction nozzle 80 vary relative to each other.

Figure 5:
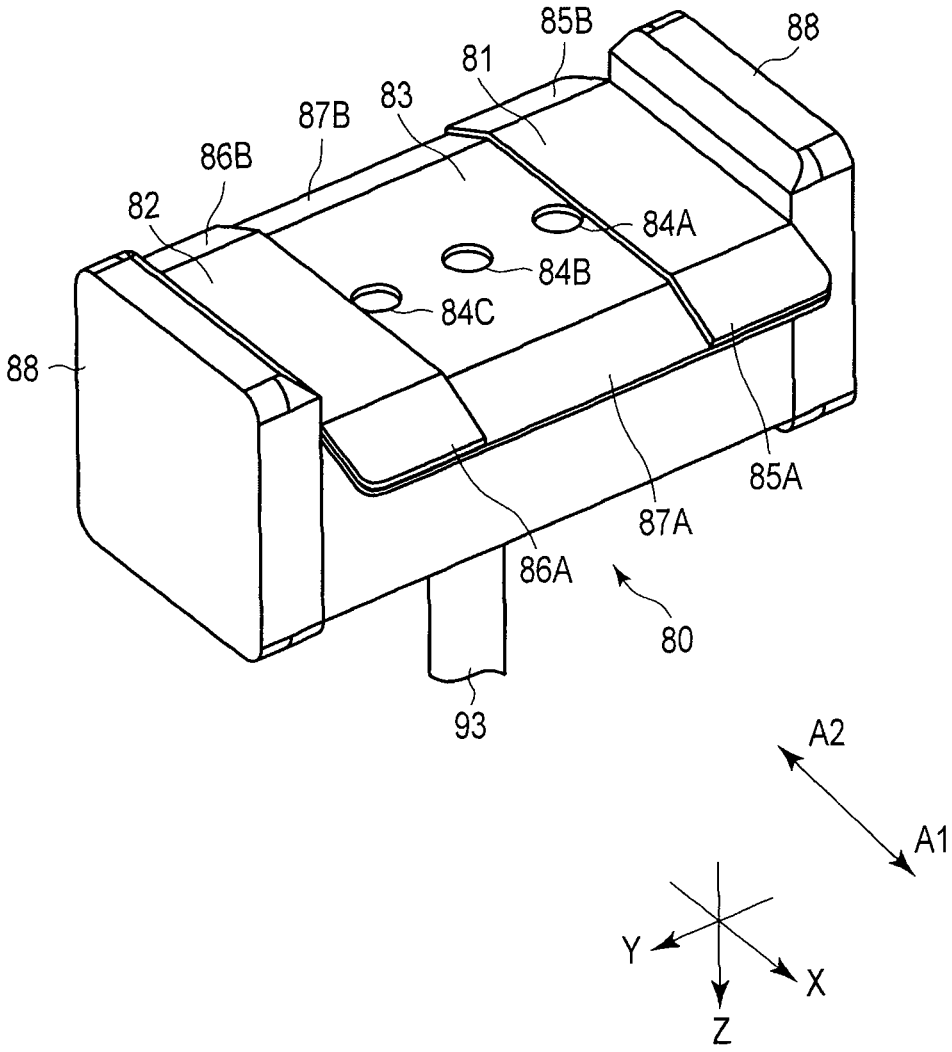
FIG. 5 is a perspective view which schematically shows the structure of a suction nozzle which constitutes the cleaning device.

FIG. 5 is a perspective view which schematically shows the structure of the suction nozzle 80 which constitutes the cleaning device shown in FIG. 4.

Specifically, the suction nozzle 80 includes ink-repellent surfaces 81 and 82 with ink repellency, an ink-affinitive surface 83 with ink affinity, which has a smaller ink contact angle than the ink-repellent surfaces 81 and 82, and a plurality of suction ports 84A to 84C which are formed in the ink-affinitive surface 83.

In the example illustrated, the ink-repellent surfaces 81 and 82 are located on both sides of the ink-affinitive surface 83. In other words, the ink-repellent surface 81, ink-affinitive surface 83 and ink-repellent surface 82 are arranged in the named order in the second direction Y. The ink-repellent surfaces 81 and 82 and the ink-affinitive surface 3 extend in the first direction X.

The ink-affinitive surface 83 is recessed from the ink-repellent surfaces 81 and 82. Specifically, the ink-repellent, surfaces 81 and 82, when opposed to the ink-jet head, project toward the ink-head jet, and the ink-affinitive surface 83 is positioned on a side away from the ink-jet head. Thus, a step is formed between the ink-repellent surfaces 81 and 82 and the ink-affinitive surface 83. The step between the ink-repellent surfaces 81 and 82 and the ink-affinitive surface 83 is, for example, 0.1 mm.

Each of the suction ports 84A to 84C is circular in the X-Y plane, and is formed to have substantially the same diameter. The diameter of each of the suction ports 84A to 84C is greater than the diameter of the nozzle hole 21, and is, for example, 30 μm. The suction ports 84A to 84C join together within the suction nozzle 80 and communicate with the conduit 93.

In addition, the suction ports 84A, 84B and 84C are located on a straight line along the second direction Y, and are arranged in the named order. In this example, the suction port 84A is located on the ink-affinitive surface 83 near the ink-repellent surface 81, the suction port 84C is located on the ink-affinitive surface 83 near the ink-repellent surface 82, and the suction port 84B between the suction ports 84A and 84C is located at a substantially central part of the ink-affinitive surface 83. The distance in the second direction Y between the center of the suction port 84A and the center of the suction port 84B and the distance between the center of the suction port 84A and the center of the suction port 84C are substantially equal. In addition, each of these distances is substantially equal to the distance between the nozzle string 211 and nozzle string 212, and is, e.g. 6 mm.

The suction nozzle 80 includes inclined surfaces 85A and 85B, 86A and 86B, and 87A and 87B, which are bent downward from the ink-repellent surfaces 81 and 82 and ink-affinitive surface 83 (i.e. bent toward a side away from the ink-jet head at a time of facing the ink-jet head).

The inclined surfaces 85A and 85B are located on both sides of the ink-repellent surface 81, and are ink-repellent. The inclined surfaces 86A and 86B are located on both sides of the ink-repellent surface 82, and are ink-repellent. The inclined surfaces 87A and 87B are located on both sides of the ink-affinitive surface 83, and are ink-affinitive.

The inclined surfaces 85A, 87A and 86A are arranged in the named order in the second direction Y, and serve as a distal end portion when the suction nozzle 80 moves forward in the direction of arrow A1. The inclined surfaces 85B, 87B and 86B are arranged in the named order in the second direction Y, and serve as a distal end portion when the suction nozzle 80 moves backward in the direction of arrow A2.

The ink-repellent surface 81 and the inclined surfaces 85A and 85B which are continuous with the ink-repellent surface 81, and the ink-repellent surface 82 and the inclined surfaces 86A and 86B which are continuous with the ink-repellent surface 82, are formed of a material having a low frictional resistance, a chemical resistance and ink repellency (e.g. a fluororesin such as polytetrafluoroethylene) or are formed by subjecting a base material to surface treatment (e.g. coating of a film formed of a fluororesin such as polytetrafluoroethylene).

The ink-affinitive surface 83 and the inclined surfaces 87A and 87B, which are continuous with the ink-affinitive surface 83, are formed of a material with ink affinity (e.g. stainless steel) or are formed by subjecting a base material to surface treatment with ink affinity (e.g. formation of a titanium oxide thin film by plasma CVD).

In the present embodiment, films of a fluororesin are coated on both side parts of a base material of stainless steel. Thereby, those parts of the base material, which are exposed, become the ink-affinitive surface 83 and inclined surfaces 87A and 87B, and those parts of the base material, which are coated with the films, become the ink-repellent surface 81 and the inclined surfaces 85A and 85B, and the ink-repellent surface 82 and the inclined surfaces 86A and 86B. The step between the ink-repellent surfaces 81 and 82 and the ink-affinitive surface 83 corresponds to the thickness of the film coated on the base material.

The suction nozzle 80 includes a guide 88 which is formed on the outside of each of the ink-repellent surfaces 81 and 82. The guide 88 projects upward (i.e. toward the side close to the ink-jet head) from the ink-repellent surface 81, 82. The guide 88 is formed of, for example, an ink-repellent material (e.g. a fluororesin such as polytetrafluoroethylene). The distance between the guides 88, between which the ink-repellent surfaces 81 and 82 and ink-affinitive surface 83 are interposed, that is, the distance between the guides 88 in the second direction Y, is substantially equal to the width of the ink-jet head in the second direction Y which is perpendicular to the longitudinal direction of the ink-jet head.

Figure 6:
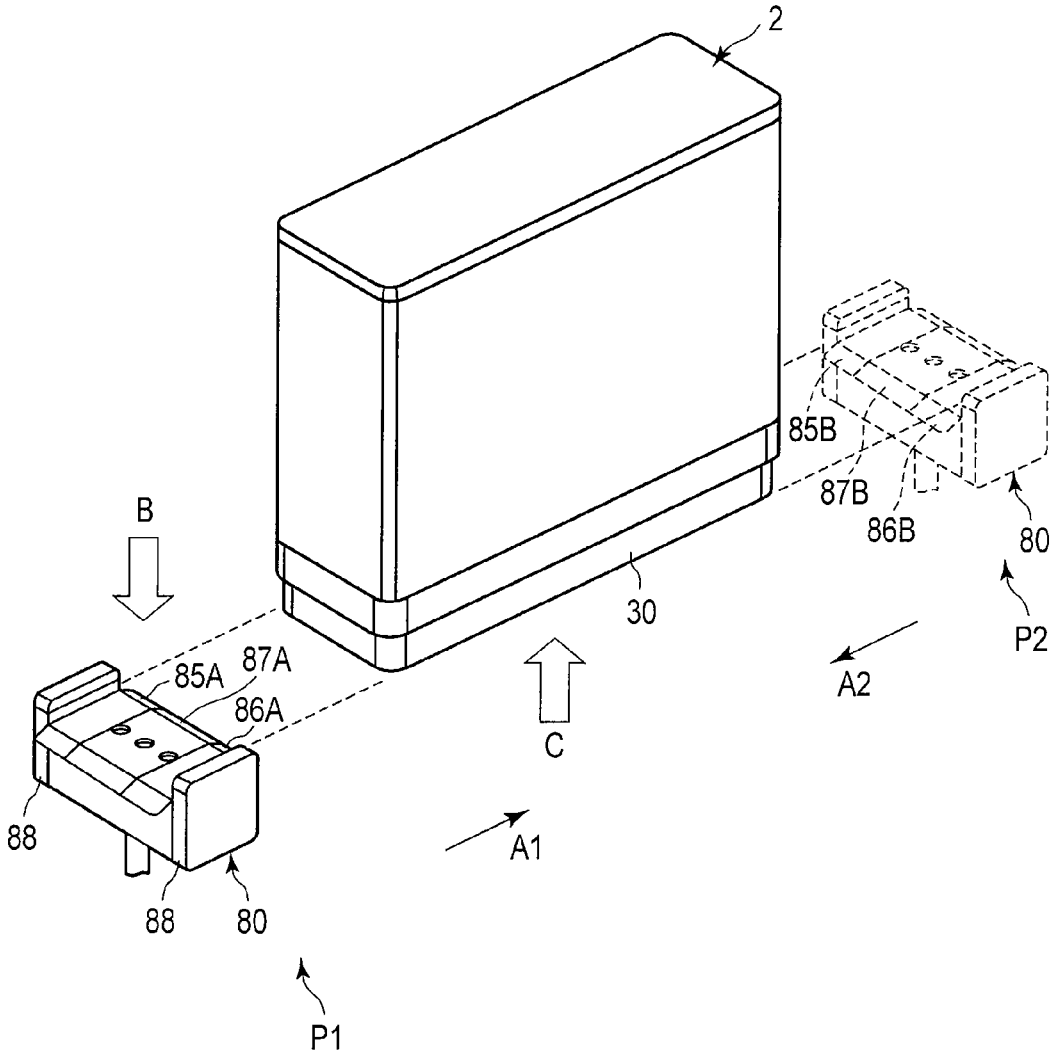
FIG. 6 is a perspective view for describing the state of movement of the suction nozzle, relative to the ink-jet head.

FIG. 6 is a perspective view for describing the state of movement of the suction nozzle 80 shown in FIG. 5, relative to the ink-jet head 2.

Specifically, the suction nozzle 80 moves from a first position (standby position) P1 in the direction of arrow A1, and advances to the position facing the ink-jet head 2, with the inclined surfaces 85A, 86A and 87A serving as a distal end portion. At this time, the suction nozzle 80 is stably and linearly movable since the pair of guides 88 of the suction nozzle 80 clamp the mask plate 30 of the ink-jet head 2.

After the suction nozzle 80 has reached a second position P2 beyond the position facing the ink-jet head 2, the suction nozzle 80 moves in the direction of arrow A2, and advances to the position facing the ink-jet head 2, with the inclined surfaces 85B, 86B and 87B serving as a distal end portion. At this time, too, the pair of guides 88 of the suction nozzle 80 clamp the mask plate 30 of the ink-jet head 2. Then, the suction nozzle 80 moves back to the first position P1.

The suction-cleaning by the suction nozzle 80 is performed at the time of at least either the movement in the direction of arrow A1 or the movement in the direction of arrow A2.

Figure 7:
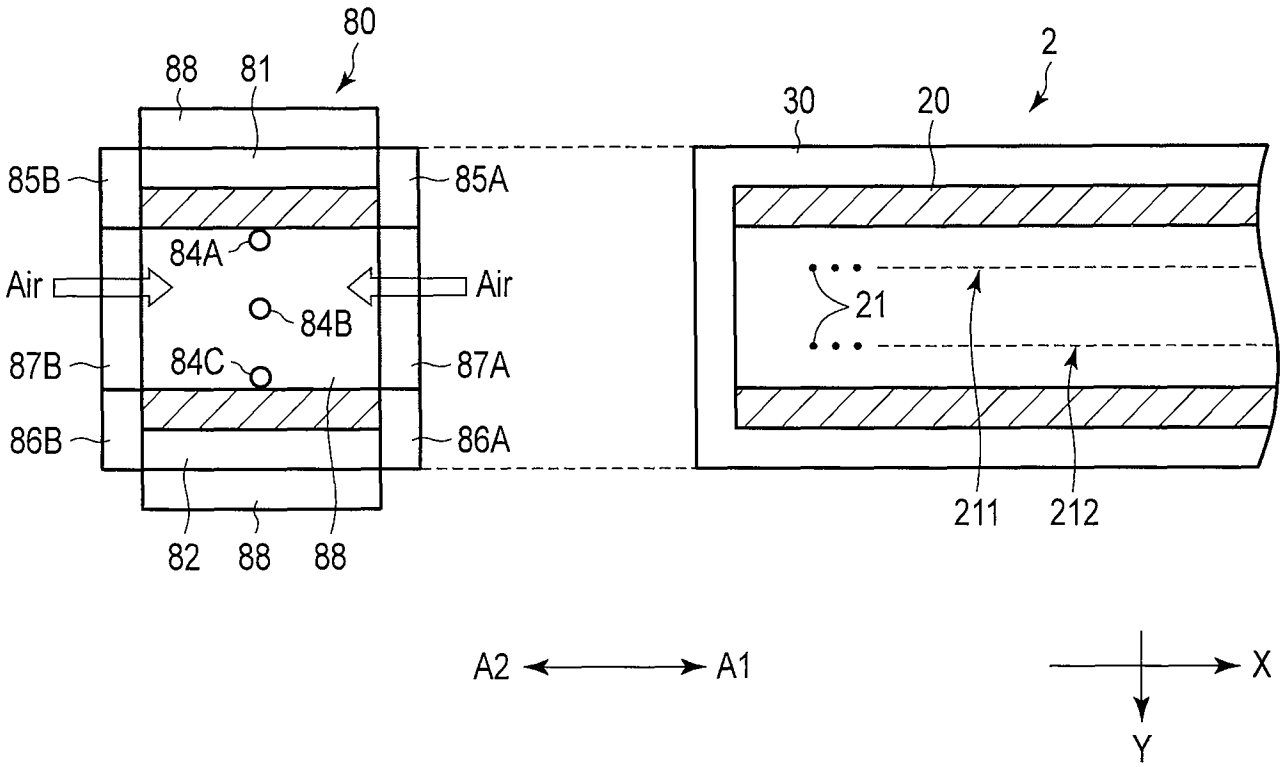
FIG. 7 shows a positional relationship between suction ports, a nozzle plate and nozzle holes at a time when the suction nozzle advances to a position facing the ink-jet head.

FIG. 7 shows a positional relationship between the suction ports 84A to 84C, the nozzle plate 20 and the nozzle holes 21 at a time when the suction nozzle 80 advances to the position facing the ink-jet head 2. FIG. 7 shows a plan view of the suction nozzle 80, as viewed in a direction B in FIG. 6, and a plan view of the ink-jet head 2, as viewed in a direction C in FIG. 6.

The width of the nozzle plate 20 in the second direction Y is greater than the width of the ink-affinitive surface 83 in the second direction Y, which is located between the ink-repellent surfaces 81 and 82. In the state in which the suction nozzle 80 faces the ink-jet head 2, the nozzle plate 20 straddles the ink-affinitive surface 83 and is opposed to both the ink-repellent surfaces 81 and 82.

As has been described above, the nozzle plate 20 of the ink-jet head 2 projects to the side of the suction nozzle 80 from the mask plate 30, and the ink-repellent surfaces 81 and 82 of the suction nozzle 80 project to the side of the ink-jet head 2 from the ink-affinitive surface 83. Thus, in the state in which the suction nozzle 80 is opposed to the ink-jet head 2, both the ink-repellent surfaces 81 and 82 are in contact with the nozzle plate 20. Specifically, hatched portions of the ink-repellent surfaces 81 and 82 come in contact with hatched portions of the nozzle plate 20. In the state in which the ink-repellent surfaces 81 and 82 are in contact with the nozzle plate 20, the ink-affinitive surface 83 is not in contact with the nozzle plate 20 and creates a gap between itself and the nozzle plate 20, as will be described later.

In the meantime, in the state in which the suction nozzle 80 is opposed to the ink-jet head 2, the mask plate 30 is in contact with neither the ink-repellent surface 81 nor ink-repellent surface 82, and, needless to say, the mask plate 30 is not in contact with the ink-affinitive surface 83.

Specifically, in the state in which the suction nozzle 80 is opposed to the ink-jet head 2, an opening is formed which can take air into the gap in the direction parallel to a direction of movement of the suction nozzle 80 (i.e. the directions of arrows A1 and A2). In a direction perpendicular to the direction of movement of the suction nozzle 80, no gap is formed since the nozzle plate 20 and ink-repellent surfaces 81 and 82 are put in contact.

The suction ports 84A to 84C of the suction nozzle 80 are formed at positions displaced from the positions where the suction ports 84A to 84C are opposed to the nozzle holes 21, which are formed in the nozzle plate 20 of the ink-jet head 2, in the state in which the suction nozzle 80 is opposed to the ink-jet head 2. Specifically, when the suction nozzle 80 moves, while being positioned immediately under (vertical direction) the ink-jet head 2, none of the suction ports 84A to 84C is located immediately under the nozzle holes 21. In other words, none of the suction ports 84A to 84C passes immediately under each of the nozzle strings 211 and 212.

In addition, the suction ports 84A to 84C are located on both sides of positions which are opposed to the nozzle strings 211 and 212. Specifically, when the suction nozzle 80 moves, while being positioned immediately under the ink-jet head 2, the suction port 84A (corresponding to a first suction port) and the suction port 84B (corresponding to a second suction port) move on both sides of the nozzle string 211, and the suction port 84B (corresponding to a first suction port) and the suction port 84C (corresponding to a second suction port) move on both sides of the nozzle string 212.

In the example illustrated, two nozzle strings 211 and 212 are formed in the nozzle plate 20. However, the number of nozzle strings may be one, or three or more. In any case, it is desirable that the suction port move on both sides of the nozzle string. Specifically, when the number of nozzle strings, which are formed in the nozzle plate 20, is n, it is desirable that the number of suction ports, which are formed in the suction nozzle 80, be at least (n+1) or more.

Figure 8:
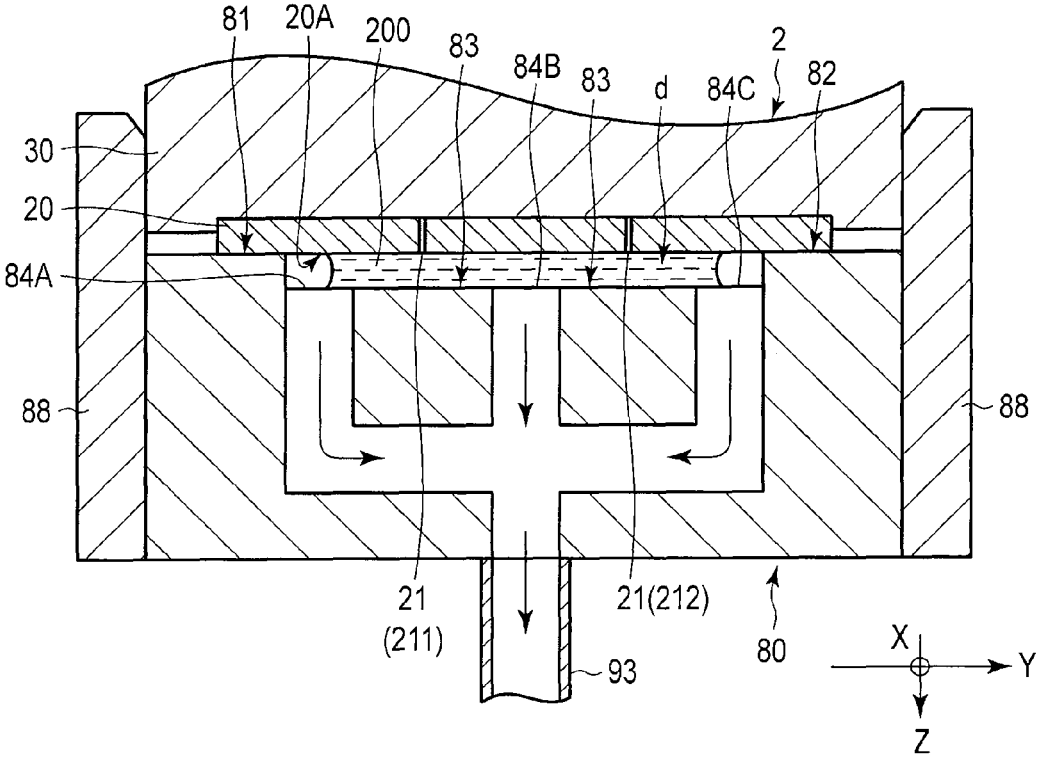
FIG. 8 is a cross-sectional view in a plane perpendicular to the direction of movement, illustrating the state in which the ink-jet head is opposed to the suction nozzle.
Figure 9:
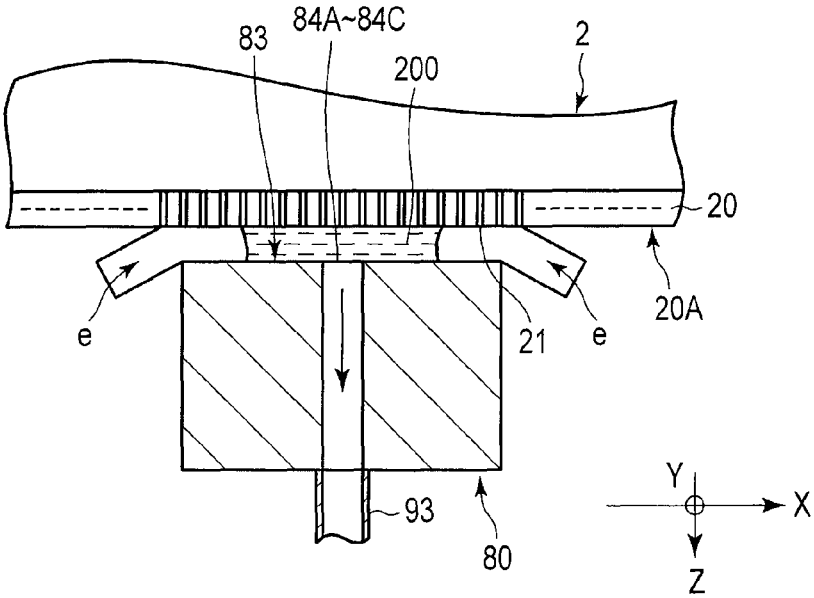
FIG. 9 is a cross-sectional view in a plane parallel to the direction of movement, illustrating the state in which the ink-jet head is opposed to the suction nozzle.

FIG. 8 is a cross-sectional view in a plane (Y-Z plane) perpendicular to the direction of movement, illustrating the state in which the ink-jet head 2 is opposed to the suction nozzle 80. FIG. 9 is a cross-sectional view in a plane (X-Z plane) parallel to the direction of movement, illustrating the state in which the ink-jet head 2 is opposed to the suction nozzle 80.

When suction-cleaning of ink, etc. adhering to the vicinity of the nozzle holes 21 on the upper surface 20A of the nozzle plate 20 is performed while the suction nozzle 80 is being moved, the nozzle plate 20, which projects to the side of the suction nozzle 80 from the mask plate 30 in the state in which the ink-jet head 2 and the suction nozzle 80 are opposed to each other, comes in contact with the ink-repellent surfaces 81 and 82 which project to the side of the ink-jet head 2 from the ink-affinitive surface 83. At this time, a gap d is created between the nozzle plate 20 and the ink-affinitive surface 83. Specifically, the nozzle holes 21 formed in the nozzle plate 20 do not come in contact with the ink-affinitive surface 83. In addition, the suction ports 84A to 84C formed in the ink-affinitive surface 83 do not come in contact with the nozzle plate 20.

The upper surface 20A of the nozzle plate 20, as described above, is treated to have ink repellency in order to stabilize the ink discharge capability (in this example, an ink-repellent film is coated). Thus, ink remaining on the upper surface 20A is repelled and tends to easily become ink drops.

On the other hand, the ink-affinitive surface 83, which creates the gap d between itself and the upper surface 20A, has affinity to ink, and combines the ink drops on the upper surface 20A. Thus, a mass of ink (also referred to as "ink pool") 200 may easily form.

If the suction by the suction nozzle 80 is started, air is taken into the gap d in a direction (first direction X) which is parallel to the direction A of movement, and an air flow e is produced toward each of the suction ports 84A to 84C. The ink pool 200 which is formed in the gap d, as well as other ink drops and contamination, is brought and joined together to the suction ports 84A to 84C by the air flow e which flows in the gap d, and is sucked from the suction ports 84A to 84C.

Thereby, the ink drops can be prevented from staying on the upper surface 20A of the nozzle plate 20, and can be cleaned. In addition, in the suction nozzle 80, minute ink drops can be prevented from staying on the ink-affinitive surface 83, and the nozzle plate 20 can be prevented from being stained with residual ink on the ink-affinitive surface. Thus, the ink discharge capability can be stabilized, and the degradation in printing performance can be prevented.

Besides, the ink-repellent surfaces 81 and 82, which slide in contact with the upper surface 20A of the nozzle plate 20, have a low frictional resistance. Thus, the suction nozzle 80 can smoothly be moved, and it is possible to prevent the upper surface 20A from being damaged, and losing ink repellency, and to prevent the upper surface 20A from failing to repel ink. Thus, the ink repellency can be maintained in the region of contact between the upper surface 20A and the ink-repellent surfaces 81 and 82.

On the ink-repellent surfaces 81 and 82, ink is repelled and the formation of an ink pool can be suppressed. Thus, the staying of ink and fixation of ink can be prevented in the region of contact between the upper surface 20A and the ink-repellent surfaces 81 and 82. Therefore, the ink discharge capability can be stabilized, and the degradation in printing performance can be prevented.

In the present embodiment, since the ink-repellent surfaces 81 and 82 are located on both sides of the ink-affinitive surface 83, it is possible to prevent spreading of an ink pool which is formed on the ink-affinitive surface 83.

In the present embodiment, the suction ports 84A to 84C of the ink-affinitive surface 83 are formed at positions facing the nozzle plate 20. In addition, the nozzle ports 21 of the nozzle plate 20 are formed at positions facing the ink-affinitive surface 83 of the suction nozzle 80. Specifically, the suction ports 84A to 84C are formed at positions displaced from positions facing the nozzle holes 21. The nozzle holes 21, which form the nozzle string 211, are opposed to positions on the ink-affinitive surface 83 between the suction port 84A and suction port 84B. The nozzle holes 21, which form the nozzle string 212, are opposed to positions on the ink-affinitive surface 83 between the suction port 84B and suction port 84C. In the example illustrated, each of the nozzle holes 21 is opposed to a substantially middle position between two neighboring suction ports.

Thus, in accordance with the movement of the suction nozzle 80, each of the suction ports 84A to 84C moves along positions displaced from positions facing the nozzle holes 21. To be move specific, the suction ports 84A and 84B move on both sides of the position facing the nozzle string 211. In addition, the suction ports 84B and 84C move on both sides of the position facing the nozzle string 212.

Thereby, the ink pool 200 can efficiently be sucked from the plural suction ports 84A to 84C. In addition, in the vicinity of the nozzle hole 21, ink can efficiently be sucked in a well-balanced fashion from the suction ports which are located on both sides of the nozzle hole 21. It is thus possible to prevent such a problem from occurring that ink is broken up and bubbles occur in the nozzle.

In the present embodiment, the suction nozzle 80 moves while clamping the mask plate 30 of the ink-jet head 2 by the pair of guides 88, so as to set the suction holes 84A to 84C and the nozzle holes 21 at proper positions. Thus, the movement of the suction nozzle 80 in the second direction Y is restricted, and the positional relationship between the suction ports 84A to 84C and the nozzle holes 21 can be kept in the proper state.

In the present embodiment, the distance in the third direction Z from the upper surface 20A of the nozzle plate 20 to the ink-affinitive surface 83, which creates the gap d, is 0.05 mm or more, and 0.1 mm or less. When the distance that creates the gap d is greater than 0.1 mm, ink drops hardly join together, and the flow rate of the air flow e, which sucks the ink pool 200, decreases, leading to a decrease in suction force for sucking the ink pool 200. On the other hand, when the distance that creates the gap d is less than 0.05 mm, the flow of air is hindered, and ink drops, etc. can hardly be brought and joined together. Thus, by setting this distance in the above-described range, the ink pool 200 can easily be formed, the air flow e with a proper flow rate for sucking the ink pool 200 can be produced, and the ink pool 200 can easily be sucked.

Figure 10:
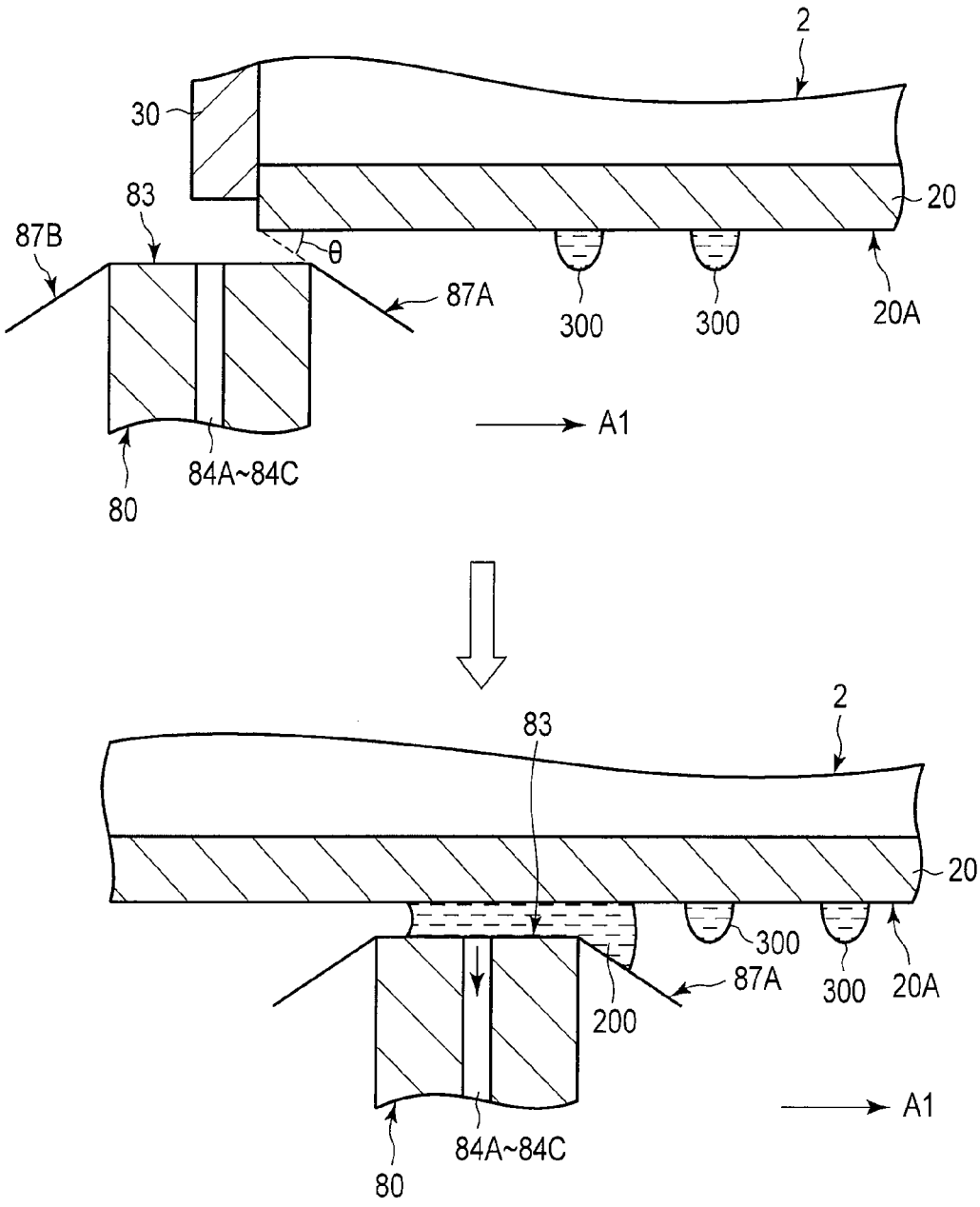
FIG. 10 is a view for explaining the function of an inclined surface of the suction nozzle in the embodiment.

FIG. 10 is a view for explaining the function of the inclined surface of the suction nozzle 80. The description below is given of the function of the inclined surface 87A which is continuous with the ink-affinitive surface 83. However, the same description applies to the inclined surface 87B.

When the suction nozzle 80 moves in the direction of arrow A1, the inclined surface 87A serves as a distal end portion which advances to the position facing the ink-jet head 2. The inclined surface 87A is set an acute angle θ(<90°) to the upper surface 20A of the nozzle plate 20. The inclined surface 87A is positioned such that the distance from the upper surface 20A increases as the distance from the ink-affinitive surface 83 becomes greater.

Like the ink-affinitive surface 83, the inclined surface 87A is not in contact with the nozzle plate 20, but the inclined surface 87A gathers and joins together ink drops 300 on the upper surface 20A of the nozzle plate 20, as the inclined surface 87A advances to the position facing the ink-jet head 2, thus forming the ink pool 200. At this time, since the inclined surface 87A is set at the acute angle to the upper surface 20A, as described above, the inclined surface 87A does not rake off the ink drops 300, and can form the ink pool 200 between itself and the upper surface 20A.

With the suction nozzle 80 moving, the suction nozzle 80 joins the ink drops 300 on the upper surface 20A of the nozzle plate 20 with the ink pool 200, and sucks the ink pool 200. At this time, the ink pool 200 between the inclined surface 87A and the upper surface 20A successively joins the ink drops 300 along the path of movement of the suction nozzle 80, while the ink pool 200 is being drawn to between the ink-affinitive surface 83 and the upper surface 20A and sucked from the suction ports 84A to 84C.

In this manner, since the distal end portion in the direction of movement of the suction nozzle 80 is the inclined surface, the suction nozzle 80 can smoothly advance to the position facing the ink-jet head 2, and does not rake off the ink drops 300 from the nozzle plate 20. Thus, contamination of the ambience can be prevented. In addition, the ink drops 300 can easily be joined with the ink pool 200. Thus, by the suction nozzle 80 sucking the ink pool 200, the ink drops 300 can be prevented from staying between the upper surface 20A of the nozzle plate 20 and the ink-affinitive surface 83.

As has been described above, according to the present embodiment, there can be provided a printing apparatus which can suppress degradation in printing capability, a cleaning device of an ink-jet head, and a cleaning method of the ink-jet head.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus comprising:

an ink-jet head comprising a nozzle plate with a nozzle string in which a plurality of nozzle holes for discharging ink are arranged; and a cleaning device comprising an ink-repellent surface with ink repellency which is configured to come in contact with the nozzle plate in a state in which the ink-repellent surface is opposed to the ink-jet head, an ink-affinitive surface with ink affinity which is configured to create a gap between the ink-affinitive surface and the nozzle plate in a state in which the ink-repellent surface is in contact with the nozzle plate, and to have a smaller ink contact angle than the ink-repellent surface, and a plurality of suction ports formed in the ink-affinitive surface.

2. The printing apparatus of claim 1, wherein when the suction nozzle is opposed to the ink-jet head, each of the suction ports is located at a position displaced from a position facing the nozzle holes.

3. The printing apparatus of claim 1, wherein the plurality of suction ports comprise a first suction port and a second suction port which are located on both sides of a position facing the nozzle string.

4. The printing apparatus of claim 1, wherein when a number of the nozzle strings is n, a number of the suction ports is at least (n+1) or more.

5. The printing apparatus of claim 1, wherein a diameter of the suction port is greater than a diameter of the nozzle hole.

6. The printing apparatus of claim 1, wherein the ink-repellent surface is located on each of both sides of the ink-affinitive surface.

7. The printing apparatus of claim 1, wherein the suction nozzle comprises a guide configured to clamp the ink-jet head in a state in which the suction nozzle is opposed to the ink-jet head.

8. The printing apparatus of claim 1, wherein the suction nozzle comprises a distal end portion which advances to a position facing the ink-jet head, the distal end portion being an inclined surface having an acute angle to an upper surface of the nozzle plate.

9. The printing apparatus of claim 1, wherein a distance from an upper surface of the nozzle plate to the ink-affinitive surface, which distance defines the gap, is 0.05 mm or more, and 0.1 mm or less.

10. The printing apparatus of claim 1, wherein an upper surface of the nozzle plate has ink repellency.

11. A cleaning device of an ink-jet head, the cleaning device comprising a suction nozzle comprising:

an ink-repellent surface with ink repellency;

an ink-affinitive surface with ink affinity which is configured to be recessed from the ink-repellent surface and to have a smaller ink contact angle than the ink-repellent surface; and a plurality of suction ports formed in the ink-affinitive surface.

12. The cleaning device of claim 11, wherein the ink-repellent surface is located on each of both sides of the ink-affinitive surface.

13. The cleaning device of claim 12, wherein the suction nozzle further comprises a guide which is located on an outside of the ink-repellent surface and projects upward from the ink-repellent surface.

14. The cleaning device of claim 11, wherein the suction nozzle further comprises an inclined surface which is bent downward from the ink-repellent surface and the ink-affinitive surface.

15. A cleaning method of an ink-jet head, comprising:

moving a suction nozzle, with an ink-repellent surface of the suction nozzle being in contact with a nozzle plate and a gap being created between an ink-affinitive surface of the suction nozzle and the nozzle plate, in a state in which the ink-jet head comprising the nozzle plate with a nozzle string, in which a plurality of nozzle holes for discharging ink are arranged, is opposed to the suction nozzle; and sucking ink, which is drawn by an air flow in the gap, from a plurality of suction ports formed in the ink-affinitive surface.

16. The cleaning method of claim 15, wherein each of the suction ports moves along a position displaced from a position facing the nozzle holes.

17. The cleaning method of claim 15, wherein the plurality of suction ports move on both sides of a position facing the nozzle string.

18. The cleaning method of claim 15, wherein the suction nozzle moves while clamping a mask plate of the ink-jet head.

19. The cleaning method of claim 15, wherein the air flow is produced by taking air into the gap in a direction parallel to a direction of movement of the suction nozzle.

* * * * *